US012515251B2

(12) United States Patent
Kimura et al.

(10) Patent No.: US 12,515,251 B2
(45) Date of Patent: Jan. 6, 2026

(54) WORKPIECE PROCESSING APPARATUS

(71) Applicants: JAPAN AVIATION ELECTRONICS INDUSTRY, LIMITED, Tokyo (JP); The University of Tokyo, Tokyo (JP)

(72) Inventors: Shinya Kimura, Tokyo (JP); Tsuyoshi Furushima, Tokyo (JP)

(73) Assignees: JAPAN AVIATION ELECTRONICS INDUSTRY, LIMITED, Tokyo (JP); THE UNIVERSITY OF TOKYO, Tokyo (JP)

( * ) Notice: Subject to any disclaimer, the term of this patent is extended or adjusted under 35 U.S.C. 154(b) by 245 days.

(21) Appl. No.: 18/201,455

(22) Filed: May 24, 2023

(65) Prior Publication Data

US 2023/0381852 A1 Nov. 30, 2023

(30) Foreign Application Priority Data

May 26, 2022 (JP) ..... 2022-086328

(51) Int. Cl.
*B21D 22/02* (2006.01)
*B21J 9/12* (2006.01)

(52) U.S. Cl.
CPC ..... *B21J 9/12* (2013.01)

(58) Field of Classification Search
CPC ..... B21D 22/02; B21D 22/20; B21D 22/205; B21D 24/04; B21D 24/06; B21D 24/08; B21D 24/14; B21D 37/10; B30B 15/0052
See application file for complete search history.

(56) References Cited

U.S. PATENT DOCUMENTS 3,208,255 A * 9/1965 Burk ..... B21D 22/205 285/222.2
3,962,895 A * 6/1976 Rydell ..... B21D 22/205 72/63

(Continued)

FOREIGN PATENT DOCUMENTS

JP S58181431 A 10/1983
JP S61119399 A 6/1986

(Continued)

OTHER PUBLICATIONS

Extended European Search Report (EESR) dated Oct. 17, 2023, issued in counterpart European Application No. 23174675.1.

*Primary Examiner* — Teresa M Ekiert
(74) *Attorney, Agent, or Firm* — Holtz, Holtz & Volek PC

(57) ABSTRACT

A workpiece processing apparatus comprises a base member, a slider located above the base member and a punch projecting downward from the slider. The base member is formed with a hydraulic chamber fillable with liquid. The hydraulic chamber has a workpiece processing chamber and a hydraulic-pressure generation chamber which are coupled together. Each of the workpiece processing chamber and the hydraulic-pressure generation chamber extends in the upper-lower direction and opens upward. The base member comprises a piston which is partially received in the hydraulic-pressure generation chamber. When the slider is moved downward, the punch is moved downward and presses the workpiece into the workpiece processing chamber, and the piston receives a downward force and is moved downward. The thus-moved piston increases hydraulic pressure of the liquid.

19 Claims, 9 Drawing Sheets

(56) References Cited

U.S. PATENT DOCUMENTS

| | | | | | |
|---|---|---|---|---|---|
| 4,357,816 | A | * | 11/1982 | Antonov | B21D 24/08 72/347 |
| 4,419,876 | A | * | 12/1983 | Spacek | B21D 22/205 72/481.2 |
| 4,472,955 | A | | 9/1984 | Nakamura et al. | |
| 5,606,910 | A | * | 3/1997 | Katz | B21D 28/002 100/269.18 |

FOREIGN PATENT DOCUMENTS

| | | | |
|---|---|---|---|
| JP | S62161435 | A | 7/1987 |
| JP | H01186223 | A | 7/1989 |
| JP | H01273624 | A | 11/1989 |
| JP | H02217117 | A | 8/1990 |
| JP | H02229624 | A | 9/1990 |
| JP | H08150426 | A | 6/1996 |
| JP | 2007014987 | A | 1/2007 |
| JP | 2021137851 | A | 9/2021 |
| SU | 1039610 | A1 | 9/1983 |
| WO | 0138019 | A1 | 5/2001 |

* cited by examiner

WORKPIECE PROCESSING APPARATUS

CROSS REFERENCE TO RELATED APPLICATIONS

This application is based on and claims priority under 35 U.S.C. § 119 to Japanese Patent Application No. JP 2022-086328 filed May 26, 2022, the content of which is incorporated herein in its entirety by reference.

BACKGROUND OF THE INVENTION

This invention relates to a workpiece processing apparatus configured to use hydraulic pressure to process a workpiece of an object.

For example, this type of workpiece processing apparatus is disclosed in JP H08-150426A (Patent Document 1), the content of which is incorporated herein by reference.

Referring to FIG. 16, Patent Document 1 discloses a workpiece processing apparatus 90 which is an existing typical workpiece processing apparatus configured to use hydraulic pressure to process a material (object) 98. The workpiece processing apparatus 90 comprises a die 91, a blank holder 92, a punch 93 and a hydraulic-pressure control device 95. The die 91 is formed with a hydraulic chamber 94. The hydraulic chamber 94 is filled with liquid such as oil. The hydraulic pressure of the liquid is controlled by the hydraulic-pressure control device 95 which includes a pump and a relief valve. The blank holder 92 can be vertically moved by a power device (not shown). The punch 93 can be vertically moved relative to the blank holder 92 by another power device (not shown). When the blank holder 92 is moved downward, the object 98 is sandwiched between the die 91 and the blank holder 92. Thereafter, when the punch 93 is moved downward, the object is drawn by using hydraulic pressure.

An existing workpiece processing apparatus such as the workpiece processing apparatus 90 disclosed in Patent Document 1 has a complex power device and a hydraulic-pressure generation mechanism and is suitable to process a large object such as a body of a car. However, there is a request for a workpiece processing apparatus which is suitable for a small object such as a shell of a connector used in an electronic device.

SUMMARY OF THE INVENTION

It is therefore an object of the present invention to provide a workpiece processing apparatus which is configured to use hydraulic pressure to process a workpiece of an object and has a structure suitable for a small object.

An aspect of the present invention provides a workpiece processing apparatus configured to use hydraulic pressure to process a workpiece of an object. The workpiece processing apparatus comprises a main member and a slider. The main member comprises a base member and a punch. The slider is located above the base member in an upper-lower direction and is movable between an upper position and a lower position in the upper-lower direction. The punch projects downward from the slider and is moved in the upper-lower direction in accordance with a movement of the slider in the upper-lower direction. The base member is formed with a hydraulic chamber. The hydraulic chamber is fillable with liquid. The hydraulic chamber has a workpiece processing chamber, a hydraulic-pressure generation chamber and a coupling chamber. Each of the workpiece processing chamber and the hydraulic-pressure generation chamber extends in the upper-lower direction and opens upward. The coupling chamber couples the workpiece processing chamber and the hydraulic-pressure generation chamber together. The base member comprises a piston. The piston is partially received in the hydraulic-pressure generation chamber so that the piston is movable in the upper-lower direction and projects upward from the hydraulic-pressure generation chamber. The piston receives a downward pressing force from the slider in a course of movement of the slider from the upper position to the lower position. When the slider is moved from the upper position toward the lower position under a state where the hydraulic chamber is filled with the liquid and the workpiece is placed on the workpiece processing chamber, the punch is moved downward and presses the workpiece into the workpiece processing chamber, and the piston is moved downward in accordance with the pressing force and increases hydraulic pressure of the liquid. The hydraulic chamber is provided with a relief valve. The relief valve controls the hydraulic pressure so that the hydraulic pressure does not exceed a predetermined value.

The workpiece processing chamber and the hydraulic-pressure generation chamber of an aspect of the present invention extend in parallel to each other in the upper-lower direction and open upward. According to this structure, by merely moving the slider downward, the object can be processed by the descending punch while the hydraulic pressure is increased to a necessary high value by the descending piston. The workpiece processing apparatus of an aspect of the present invention has the simple mechanism as described above and can be reduced in size. An aspect of the present invention provides a workpiece processing apparatus which is configured to use hydraulic pressure to process a workpiece of an object and has a structure suitable for a small object.

An appreciation of the objectives of the present invention and a more complete understanding of its structure may be had by studying the following description of the preferred embodiment and by referring to the accompanying drawings.

Figure 1:
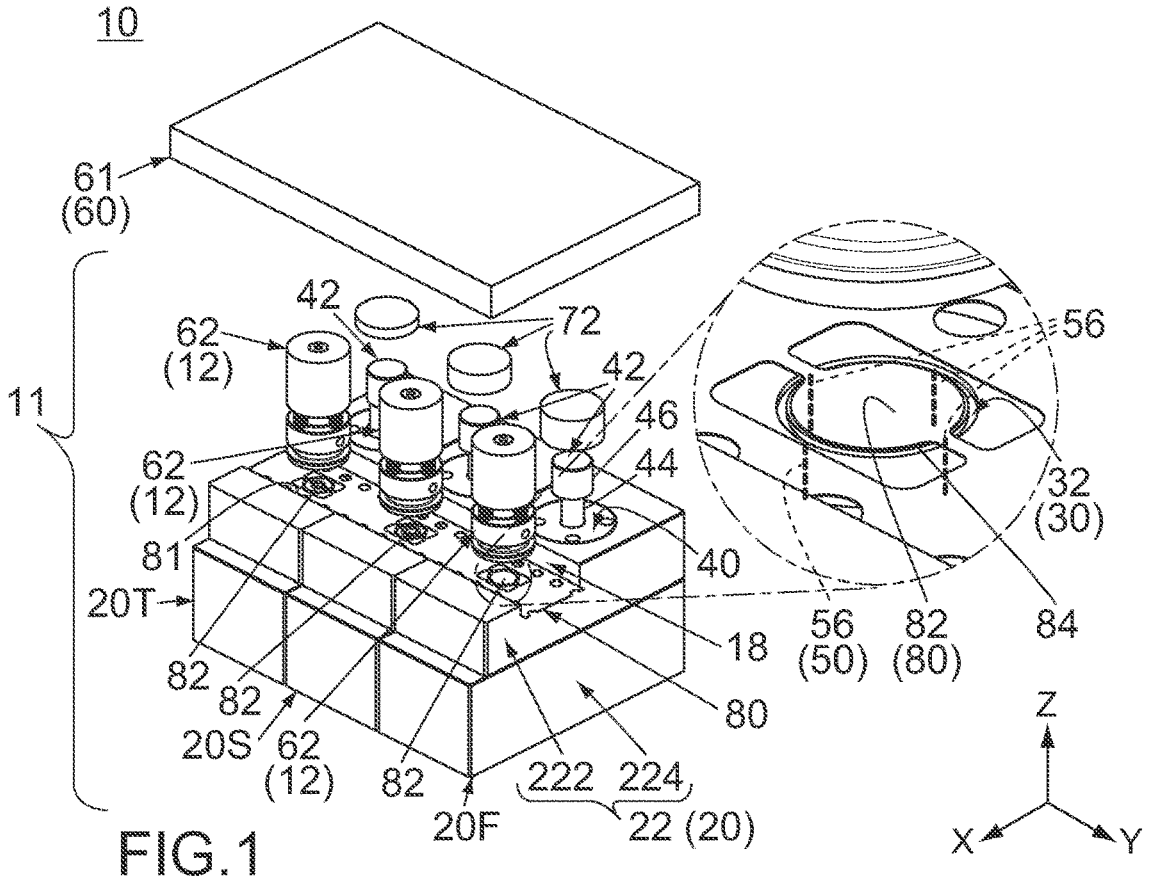
FIG. 1 is a perspective view showing a workpiece processing apparatus according to an embodiment of the present invention, wherein an object is placed on the workpiece processing apparatus, although illustrated punches and illustrated spacers are apart from a slider, the actual punches and the actual spacers are fixed to the slider, a part of the workpiece processing apparatus enclosed by chain dotted lines is enlarged and illustrated, and in the enlarged view, positions of hidden branch channels are illustrated with dashed line.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DETAILED DESCRIPTION

Referring to FIG. 1, a workpiece processing apparatus 10 according to an embodiment of the present invention is a workpiece processing apparatus configured to use hydraulic pressure to process a workpiece (blank) 82 of an object 80. "Hydraulic pressure" of the present embodiment is a pressure applied to the workpiece 82 by liquid 50L (see FIG. 5) as described later and is a concept including "hydraulic counterpressure OP" and "peripheral hydraulic pressure PP" described later. The object 80 of the present embodiment is a single metal plate and has a thin flat-plate shape before being processed. Referring to FIG. 1 together with FIG. 4, the illustrated object 80 has a carrier 81 and three of the workpieces 82 connected to the carrier 81.

The workpiece processing apparatus 10 of the present embodiment is suitable for progressive processing of the object 80. However, the present invention is not limited thereto but is applicable to an apparatus which performs transfer processing to the object 80. Moreover, the object 80 may be one of the workpieces 82 separated from the carrier 81. Thus, the workpiece processing apparatus 10 may be an apparatus which performs single-shot processing to only one of the workpieces 82.

Figure 2:
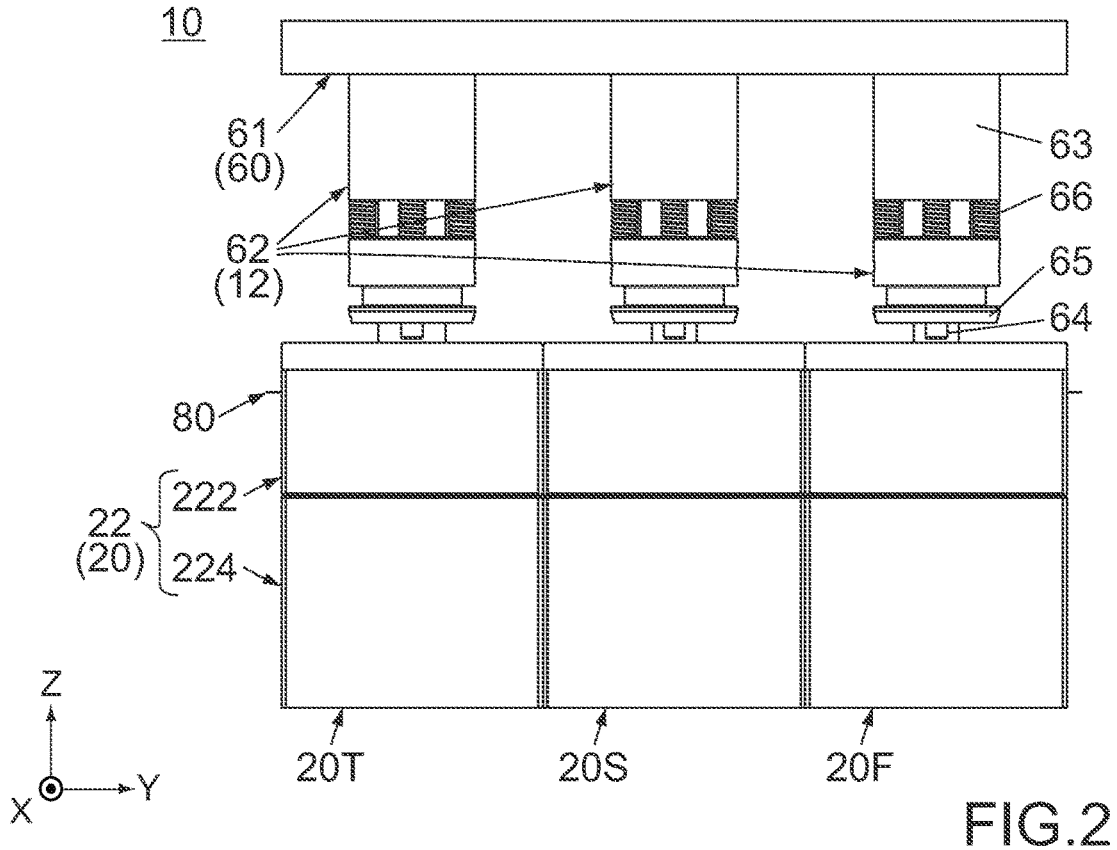
FIG. 2 is a front view showing the workpiece processing apparatus of FIG. 1.
Figure 3:
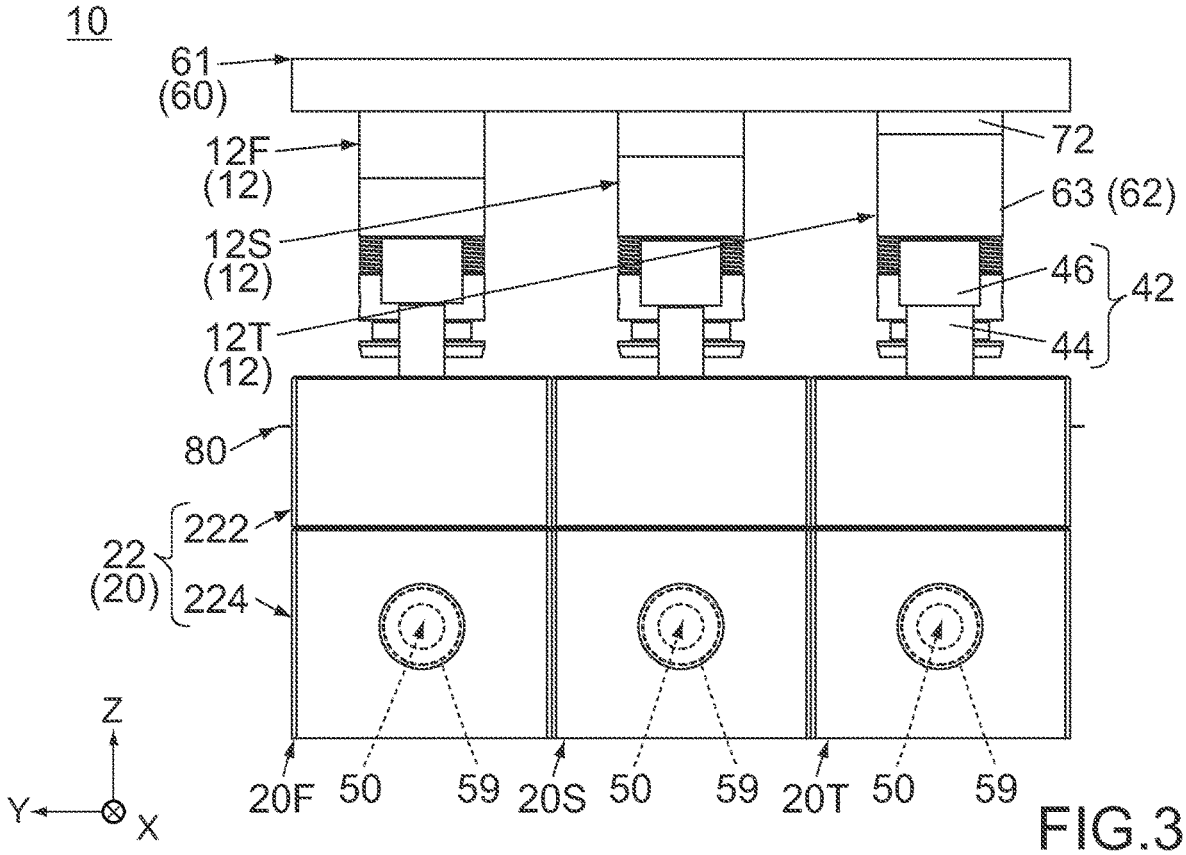
FIG. 3 is a rear view showing the workpiece processing apparatus of FIG. 1, wherein positions of hidden hydraulic chambers and positions of relief valves are illustrated with dashed line.

As shown in FIGS. 1 to 3, the workpiece processing apparatus 10 of the present embodiment comprises one base member 20 and one movable member 60. The movable member 60 is located above the base member 20 in an upper-lower direction. The upper-lower direction of the present embodiment is the Z-direction. In the present embodiment, "upward" means the positive Z-direction, and "downward" means the negative Z-direction. The upper-lower direction is preferred to be aligned with the gravity direction. However, the present invention is not limited thereto. For example, the upper-lower direction may intersect with the gravity direction within a range in which the object 80 can be processed.

As shown in FIG. 1, the base member 20 is formed with a channel 18. The channel 18 is a space recessed downward. The channel 18 continuously extends along a lateral direction perpendicular to the upper-lower direction and opens outward at opposite ends thereof in the lateral direction. The lateral direction of the present embodiment is the Y-direction. The channel 18 has a bottom surface which extends along a horizontal plane (XY-plane) perpendicular to the upper-lower direction. The object 80 is placed on the bottom surface of the channel 18. The workpieces 82 of the object 80 are arranged in the lateral direction.

Referring to FIGS. 1 to 3, the workpiece processing apparatus 10 of the present embodiment comprises only the base member 20 and the movable member described above. The workpiece processing apparatus 10 has a small size of at most several tens of centimeters in the lateral direction. However, the present invention is not limited thereto but is applicable to a large workpiece processing apparatus 10. Moreover, the workpiece processing apparatus 10 may further comprise another member in addition to the aforementioned members.

The base member 20 of the present embodiment comprises three base members 20F, 20S and 20T, namely a first member (base member) 20F, a second member (base member) 20S and a third member (base member) 20T. The base members 20F, 20S and 20T are arranged in the lateral direction. The three base members 20F, 20S and 20T can process the three workpieces 82, respectively.

A forming process of the present embodiment includes three processing steps. The workpiece processing apparatus 10 of the present embodiment comprises the three base members 20F, 20S and 20T which are used in the three processing steps, respectively. The base members 20F, 20S and 20T of the present embodiment are formed separately from each other and are arranged in the lateral direction with no gap left therebetween. According to the present embodiment, two or more of the base members 20F, 20S, 20T, etc. can be arranged in accordance with the number of the processing steps. However, the present invention is not limited thereto. For example, the base members 20F, 20S and 20T may be formed integrally with each other. When the number of the processing steps is one, the workpiece processing apparatus 10 may comprise only the one base member 20F.

The base members 20F, 20S and 20T of the present embodiment have outlines same as each other and have structures similar to each other. However, the present invention is not limited thereto. For example, the base members 20F, 20S and 20T may have outlines different from each other and may have structures different from each other.

Hereafter, explanation will be made about the base member 20F of the present embodiment. The explanation described below is applicable to each of the base members 20S and 20T.

Figure 5:
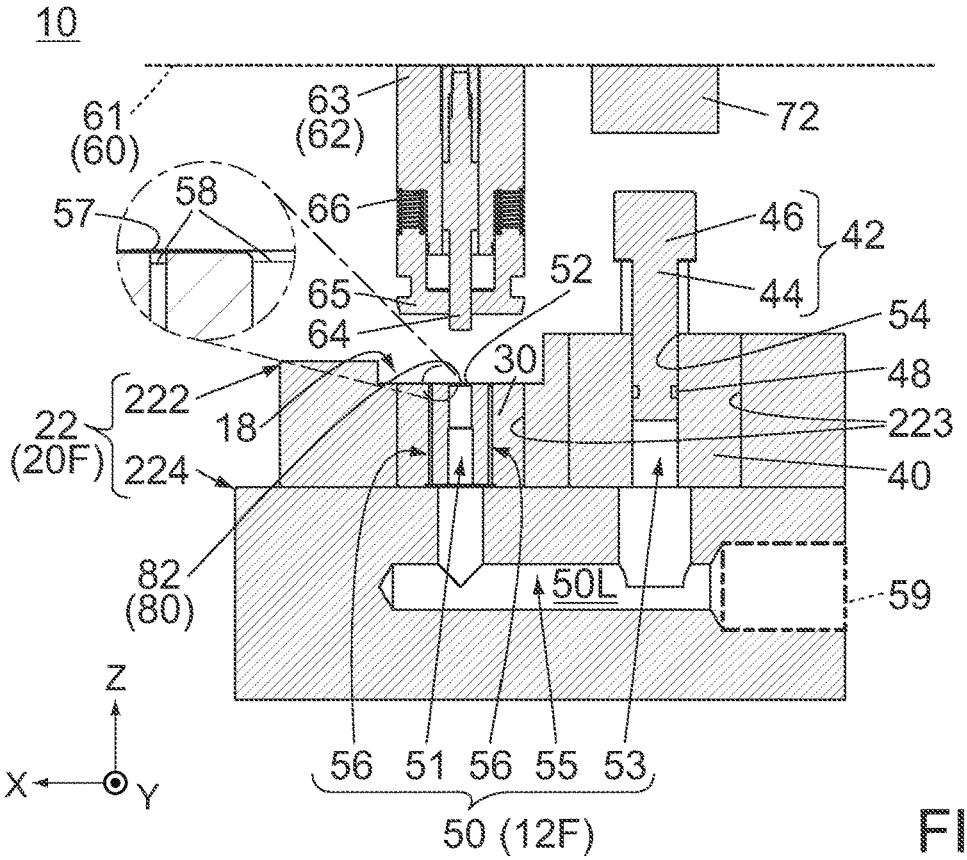
FIG. 5 is a cross-sectional view showing the workpiece processing apparatus of FIG. 4, taken along line V-V, wherein the slider is located at an upper position, a position of a lower end of the slider and a position of the relief valve are illustrated with dashed line, and a part of the workpiece processing apparatus enclosed by chain dotted lines is enlarged and illustrated.

Referring to FIG. 5 together with FIG. 1, the base member 20F of the present embodiment comprises a bed 22, a die 30 made of metal, a cylinder 40 made of metal and a piston 42 made of metal. The bed 22 comprises an upper member 222 made of metal and a lower member 224 made of metal. The upper member 222 is placed on the lower member 224. The upper member 222 is formed with the aforementioned channel 18. The base member 20F is formed with a hydraulic chamber 50. The hydraulic chamber 50 is an inner space located in the base member 20F and is closed in the base member 20F except for some openings described later. The hydraulic chamber 50 is fillable with the liquid 50L such as oil. The illustrated hydraulic chamber 50 is filled with the liquid 50L.

Referring to FIG. 5, the base member 20F of the present embodiment is formed of the upper member 222, the lower member 224, the die 30, the cylinder 40 and the piston 42 combined together. According to this structure, the hydraulic chamber 50 can be easily formed. However, the present invention is not limited thereto. For example, the upper member 222, the die 30 and the cylinder 40 may be formed integrally with each other. The base member 20F may further comprise another member in addition to the aforementioned members.

Each of the die 30 and the cylinder 40 of the present embodiment has a cylindrical shape extending in the upper-lower direction. Each of the die 30 and the cylinder 40 is formed with a center hole which has a cylindrical shape extending in the upper-lower direction. The upper member 222 is formed with two attachment holes 223 each having a cylindrical shape. The die 30 and the cylinder 40 are ft into the two attachment holes 223, respectively. These cylindrical members can be easily fit into the cylindrical holes while eliminating gaps through which the liquid 50L might leak. However, the present invention is not limited thereto. The shapes of the die 30 and the cylinder 40 are not specifically limited, provided that each of the die 30 and the cylinder 40 is formed with the center hole.

Figure 11:
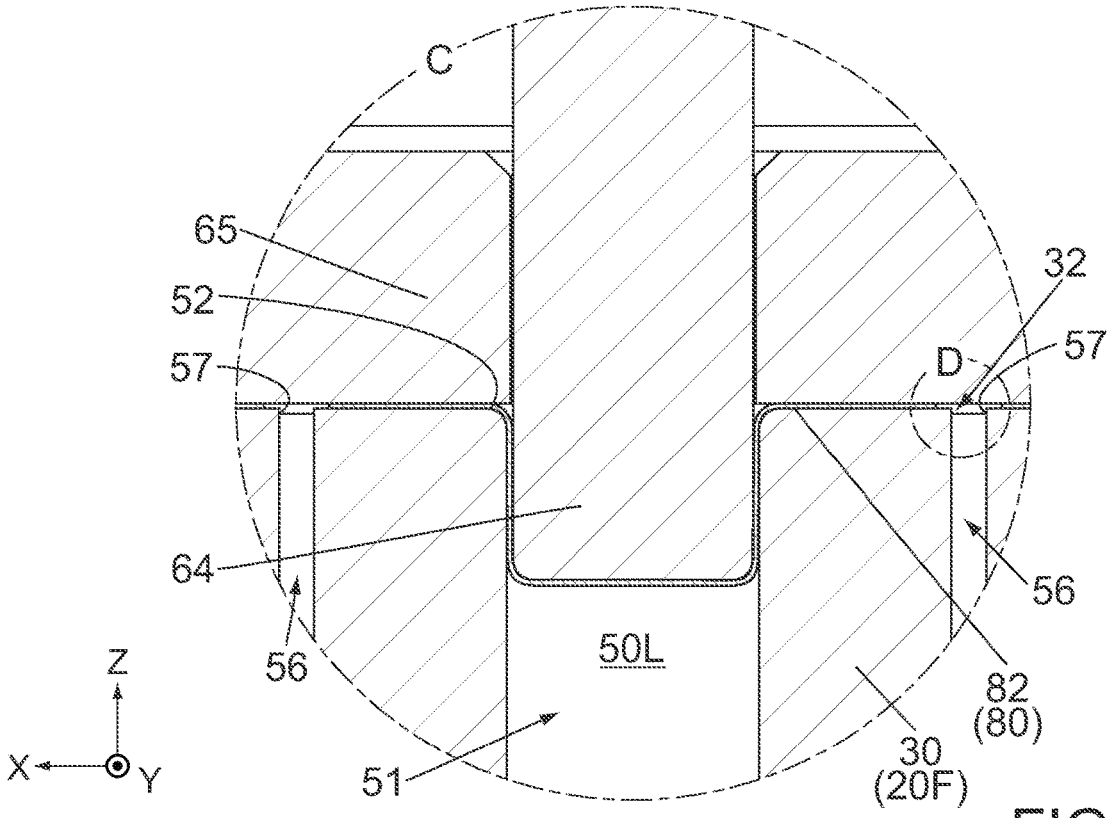
FIG. 11 is an enlarged, cross-sectional view showing a part of the workpiece processing apparatus enclosed by chain dotted lines C of FIG. 10.

The die 30 and the cylinder 40 have upper end surfaces which are exposed upward from the upper member 222. The die 30 is located forward of the cylinder 40 in a front-rear direction perpendicular to both the upper-lower direction and the lateral direction. The front-rear direction of the present embodiment is the X-direction. In the present embodiment, "forward" means the positive X-direction, and "rearward" means the negative X-direction. The upper end surface of the die 30 forms a part of the bottom surface of the channel 18. Referring to FIGS. 1 and 11, the upper end surface of the die 30 is formed with a recess 32. The recess 32 is a space which is recessed downward. The recess 32 has a ring shape in the XY-plane and encloses the center hole of the die 30.

As shown in FIG. 5, the hydraulic chamber 50 has a workpiece processing chamber 51, a hydraulic-pressure generation chamber 53 and a coupling chamber 55. Each of the workpiece processing chamber 51 and the hydraulic-pressure generation chamber 53 extends in the upper-lower direction and opens upward. In other words, the workpiece processing chamber 51 and the hydraulic-pressure generation chamber 53 extend in parallel to each other along the upper-lower direction and have openings 52 and 54, respectively. The coupling chamber 55 couples the workpiece processing chamber 51 and the hydraulic-pressure generation chamber 53 together.

The workpiece processing chamber 51 of the present embodiment extends through the center hole of the die 30. The opening 52 of the workpiece processing chamber 51 is located at the upper end surface of the die 30. The hydraulic-pressure generation chamber 53 of the present embodiment extends through the center hole of the cylinder 40. The opening 54 of the hydraulic-pressure generation chamber 53 is located at the upper end surface of the cylinder 40 and is located above the opening 52. Each of the workpiece processing chamber 51 and the hydraulic-pressure generation chamber 53 has a circular shape in the XY-plane. The coupling chamber of the present embodiment extends along the front-rear direction and couples a lower end of the workpiece processing chamber 51 and a lower end of the hydraulic-pressure generation chamber 53 together. The coupling chamber 55 has a circular shape in a perpendicular plane (YZ-plane) perpendicular to the front-rear direction.

Figure 8:
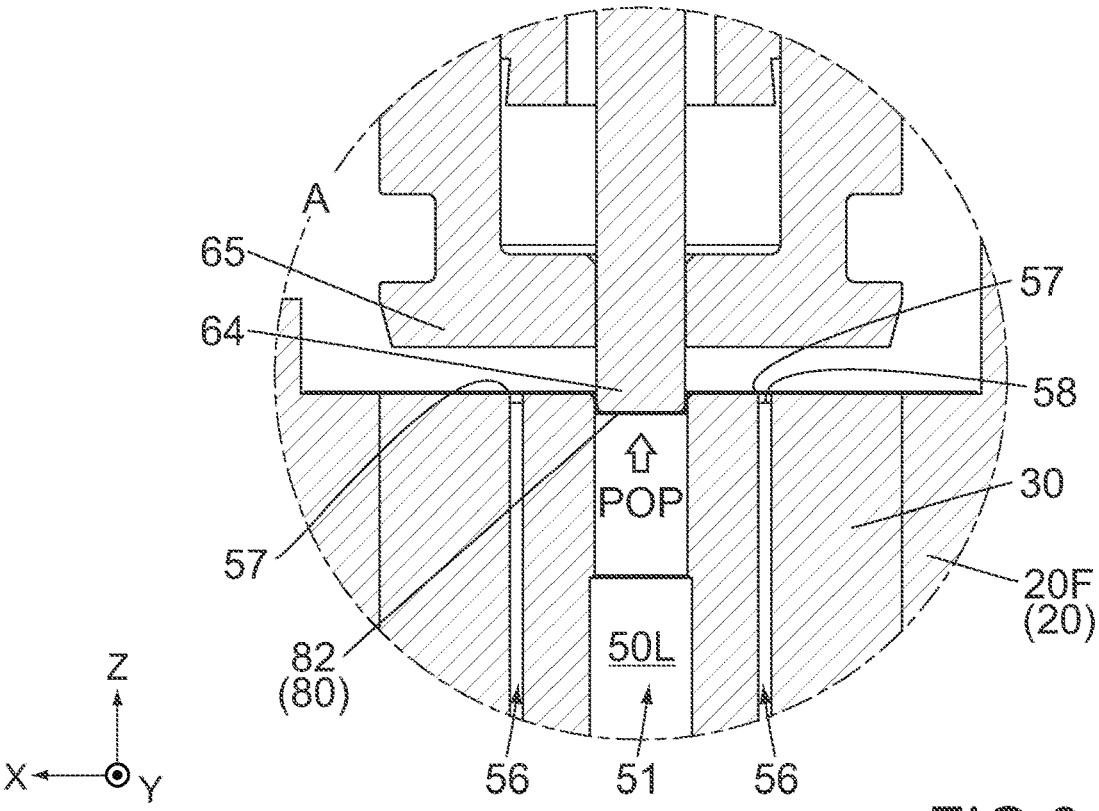
FIG. 8 is an enlarged, cross-sectional view showing a part of the workpiece processing apparatus enclosed by chain dotted lines A of FIG. 7.

Referring to FIGS. 5 and 8 together with FIG. 1, the hydraulic chamber 50 of the present embodiment further has four branch channels 56. The four branch channels 56 are located forward of the workpiece processing chamber 51, rearward of the workpiece processing chamber 51 and at opposite sides of the workpiece processing chamber 51 in the lateral direction, respectively. Each of the branch channels 56 branches off from the workpiece processing chamber 51. In detail, a part of a lower end surface of the die 30 is located slightly above an upper end surface of the lower member 224, and this arrangement forms a flow channel which extends outward from the workpiece processing chamber 51 in the XY-plane. Each of the branch channels 56 extend upward from this flow channel.

Each of the branch channels 56 extends in parallel to the workpiece processing chamber 51 along the upper-lower direction through a small hole formed in the die 30 and opens upward. Each of the thus-formed branch channels 56 has an opening 57 which opens outward from the base member 20F. Referring to FIG. 11, each of the openings 57 is located at a bottom surface of the recess 32 of the die 30. Each of the thus-formed openings 57 is located slightly below the opening 52 of the workpiece processing chamber 51.

Referring to FIG. 5, the hydraulic chamber 50 of the present embodiment has the aforementioned structure. However, the present invention is not limited thereto, but the structure of the hydraulic chamber 50 can be modified as necessary. For example, the branch channels 56 may be provided as necessary. In contrast, the hydraulic chamber 50 may further have another portion in addition to the aforementioned portions.

The hydraulic chamber 50 is provided with a relief valve 59. The relief valve 59 is partially connected to the hydraulic chamber 50 and is partially exposed outward from the base member 20F. The relief valve 59 is closed under a state where the object 80 is not yet processed as shown in FIG. 5. When the relief valve 59 is closed, a liquid surface 58 of the liquid 50L is located below the openings 52 and 57. Thus, the liquid 50L is kept in the hydraulic chamber 50. The hydraulic pressure of the liquid 50L is made higher as the object 80 is processed. When the hydraulic pressure of the liquid 50L exceeds a predetermined value, the relief valve 59 opens, and a part of the liquid 50L is discharged outward from the base member 20F. As a result, the hydraulic pressure of the liquid 50L is lowered to a value equal to or less that the predetermined value. The relief valve 59 of the present embodiment is located rearward of the lower end of the hydraulic-pressure generation chamber 53. However, the present invention is not limited thereto. For example, the arrangement and the inner structure of the relief valve 59 are not specifically limited.

As shown in FIGS. 1 and 5, the piston 42 of the present embodiment has a body 44 and a pressed portion 46. Each of the body 44 and the pressed portion 46 has a cylindrical shape extending along the upper-lower direction. The pressed portion 46 has a size in the XY-plane which is larger than another size of the body 44 in the XY-plane. The body 44 extends downward from a lower end of the pressed portion 46.

Referring to FIG. 5, the piston 42 is partially received in the hydraulic-pressure generation chamber 53 so that the piston 42 is movable in the upper-lower direction and projects upward from the hydraulic-pressure generation chamber 53. In detail, the body 44 is inserted into the hydraulic-pressure generation chamber 53 through the opening 54. The thus-inserted body 44 has a lower part which is received in the center hole formed in the cylinder 40 substantially with no gap left therebetween. The body 44 also has an upper part which projects upward from the hydraulic-pressure generation chamber 53. The thus-arranged body 44 is movable along the upper-lower direction. The lower end of the body 44 is in contact with the liquid 50L. An O-ring 48 is attached to the lower part of the body 44 so that leakage of the liquid 50L is prevented. The piston 42 of the present embodiment has the aforementioned structure. However, the present invention is not limited thereto. For example, the O-ring 48 may be provided as necessary.

Hereafter, explanation will be made about the movable member 60 of the present embodiment.

Figure 4:
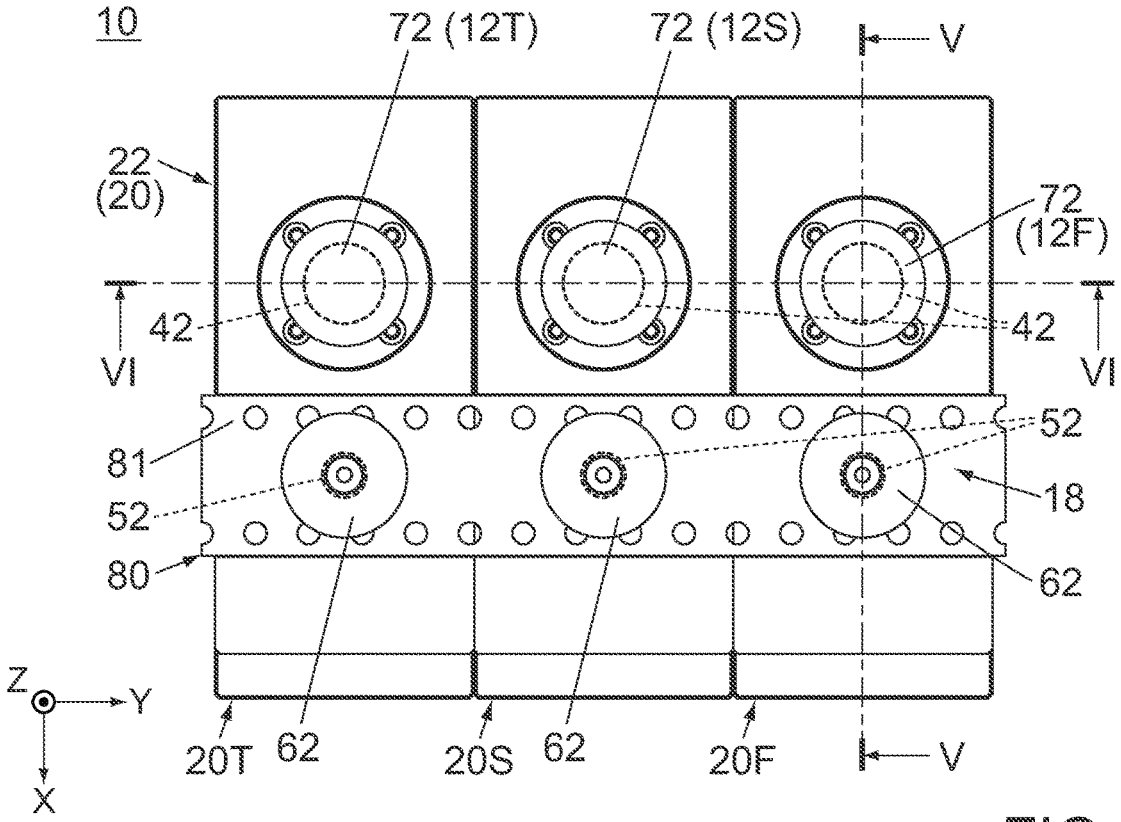
FIG. 4 is a plan view showing the workpiece processing apparatus of FIG. 1, wherein the slider is not illustrated, and positions of openings of hidden workpiece processing chambers and positions of hidden pistons are illustrated with dashed line.

Referring to FIG. 1, the movable member 60 of the present embodiment comprises a slider 61, three workpiece processing members 62 and three spacers (pressing portions) 72 each made of metal. The three workpiece processing members 62 are provided so that they correspond to the three base members 20F, 20S and 20T, respectively. The three spacers 72 are also provided so that they correspond to the three base members 20F, 20S and 20T, respectively. Referring to FIG. 4, the workpiece processing members 62 are located at positions which correspond to those of the openings 52 of the workpiece processing chambers 51 in the XY-plane, respectively. The spacers 72 are located at positions which correspond to those of the pistons 42 in the XY-plane, respectively. The number of the workpiece processing members 62 and the number of the spacers 72 may correspond to the number of the members which process the workpieces 82 of the object 80. For example, when the workpiece processing apparatus 10 comprises only the base member 20F, the number of the workpiece processing member 62 and the number of the spacers 72 may be one.

Referring to FIG. 2, each of the workpiece processing members 62 of the present embodiment comprises a base 63 made of metal, a punch 64 made of metal, a holder 65 made of metal and a holder-support member 66 formed of one or more metal springs. Thus, referring to FIG. 2 together with FIG. 1, the workpiece processing apparatus 10 of the present embodiment comprises the single slider 61, the three bases 63, the three punches 64, the three holders 65, the three holder-support members 66 and the three spacers 72. Each of the punches 64 and the spacers 72 has a circular shape in the XY-plane. Each of the bases 63 and the holders 65 has a circular ring shape in the XY-plane.

The movable member 60 of the present embodiment comprises the aforementioned members. However, the present invention is not limited thereto. For example, the shape of each member is not specifically limited. The bases 63, the holders 65, the holder-support members 66 and the spacers 72 may be provided as necessary. When the base member 20 comprises only the base member 20F, the movable member 60 may comprise only one of the punches 64 corresponding to the base member 20F in addition to the slider 61. Instead, the movable member 60 may further comprise another member in addition to the aforementioned members.

Figure 9:
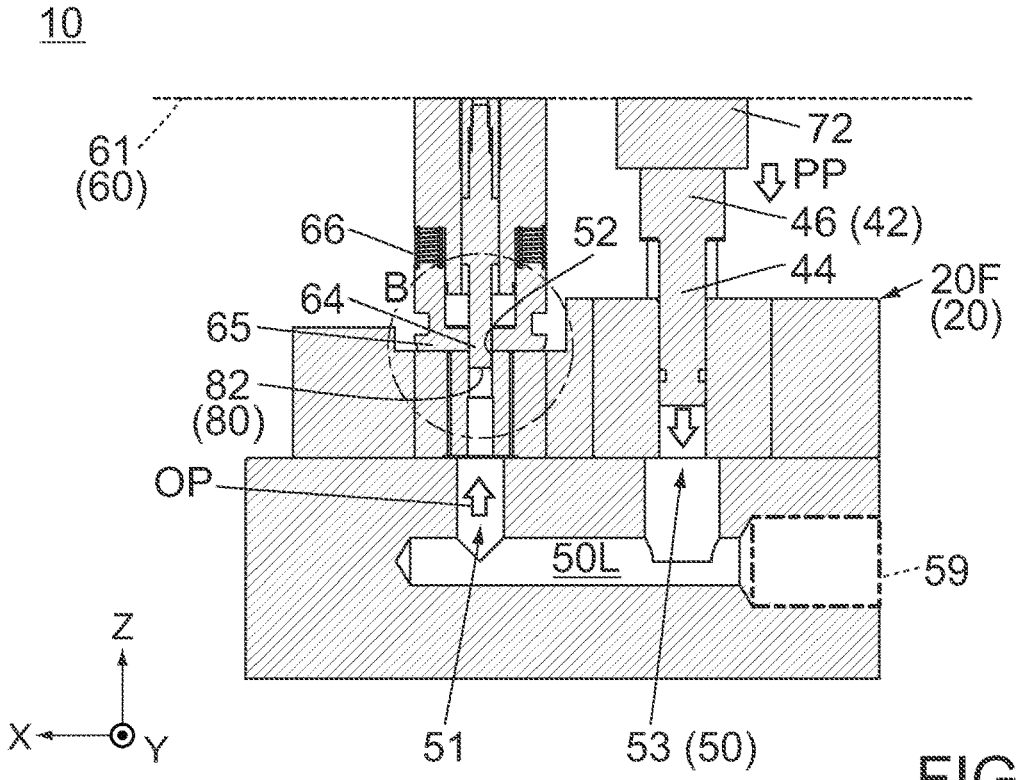
FIG. 9 is another cross-sectional view showing the workpiece processing apparatus of FIG. 7, wherein the slider is further moved downward and is located at a lower position.

Referring to FIGS. 1 to 3, the slider 61 is located above the base member 20 in the upper-lower direction. The slider 61 is supported by a power device (not shown) and is movable in the upper-lower direction between an upper position at which the object 80 is not processed as shown in FIGS. 1 to 3 and a lower position at which the object 80 is processed as shown in FIG. 9. The slider 61 of the present embodiment has a flat-plate shape extending along the XY-plane. However, the shape and the inner structure of the slider 61 of the present invention are not specifically limited.

Referring to FIG. 2 together with FIG. 1, the three punches 64, the three holders 65 and the three spacers 72 of the present embodiment process the three workpieces 82 of the object 80, respectively, in cooperation with the three base members 20F, 20S and 20T, respectively. In other words, referring to FIG. 3, the workpiece processing apparatus 10 of the present embodiment comprises three workpiece processing sets 12 configured to process the workpieces 82 (see FIG. 1), respectively. In detail, the workpiece processing apparatus 10 of the present embodiment comprises the three workpiece processing sets 12 consisting of a first set (workpiece processing set) 12F, a second set (workpiece processing set) 12S and a third set (workpiece processing set) 12T. However, the present invention is not limited thereto, but the number of the workpiece processing sets 12 may be one, two or more than three. For example, the workpiece processing apparatus 10 may comprise only the one workpiece processing set 12F or may comprise two or more of the workpiece processing sets 12.

Hereafter, explanation will be made about the workpiece processing sets 12 of the present embodiment.

Figure 6:
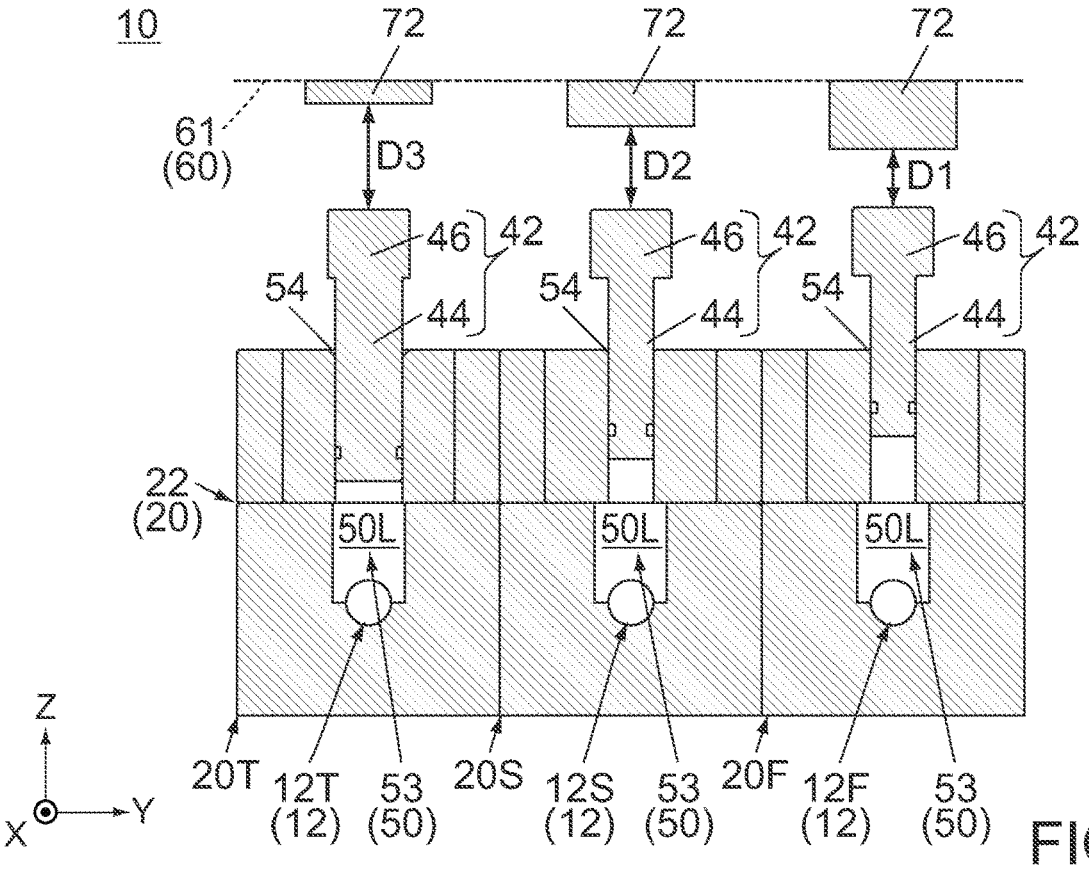
FIG. 6 is a cross-sectional view showing the workpiece processing apparatus of FIG. 4, taken along line VI-VI, wherein the slider is located at the upper position, and a position of the lower end of the slider is illustrated with dashed line.

Referring to FIG. 6 together with FIG. 2, each of the workpiece processing sets 12 of the present embodiment includes the hydraulic chamber 50, the piston 42, the punch 64, the holder 65 and the spacer 72. However, the present invention is not limited thereto. For example, the workpiece processing apparatus 10 may comprise none of the holders 65 and none of the spacers 72 as previously described. In this instance, each of the workpiece processing sets 12 should comprise the hydraulic chamber 50, the piston 42 and the punch 64.

Referring to FIG. 6, each of the pistons 42 of the present embodiment has the previously described body 44. Each of the bodies 44 is partially received in the hydraulic-pressure generation chamber 53 and the lower end thereof is in contact with the liquid 50L.

Referring to FIG. 5 together with FIG. 2, each of the punches 64 of the present embodiment is fixed to the slider 61 by a fixing member such as a screw and extends downward from a lower end surface of the slider 61. Each of the bases 63 of the present embodiment is fixed to the slider 61 by a fixing member such as a screw. Each of the bases 63 extends downward from the lower end surface of the slider 61 while enclosing the punch 64 in the XY-plane.

Each of the holder-support members 66 of the present embodiment is attached to an outer circumference of the base 63 in the XY-plane and extends along the upper-lower direction. Each of the holders 65 of the present embodiment is located outward of the punch 64 in the XY-plane. In other words, each of the holders enclosed the punch 64 in the XY-plane. Each of the holders 65 is attached to a lower end of the holder-support member 66. Each of the holder-support members 66 has resiliency and support the holder 65 so that the holder 65 is movable relative to the slider 61. Each of the punches 64 projects downward beyond a lower end of the holder 65.

Each of the spacers 72 of the present embodiment is fixed to the slider 61 by a fixing member such as a screw and extends downward from the lower end surface of the slider 61.

Referring to FIGS. 2 and 3, all the punches 64 and all the spacers 72 of the present embodiment are directly fixed to the single slider 61 and project downward from the single slider 61. All the holders 65 of the present embodiment are indirectly fixed to the single slider 61 via the holder-support members 66 each having resiliency and project downward from the single slider 61. Therefore, by merely moving the single slider 61 in the upper-lower direction, all the punches 64, all the holders 65 and all the spacers 72 are moved in the upper-lower direction.

Referring to FIG. 2, each of the workpiece processing sets 12 of the present embodiment has the aforementioned structure. However, the present invention is not limited thereto. For example, the structure for supporting the holder 65 is not specifically limited. The holder-support member 66 is not limited to the metal springs, provided that the holder-support member 66 has resiliency.

Referring to FIG. 3, hereafter, explanation will be made about the processing steps performed by the first set 12F which is one of the workpiece processing sets 12 of the present embodiment. The explanation described below is applicable to each of the second set 12S and the third set 12T.

Figure 7:
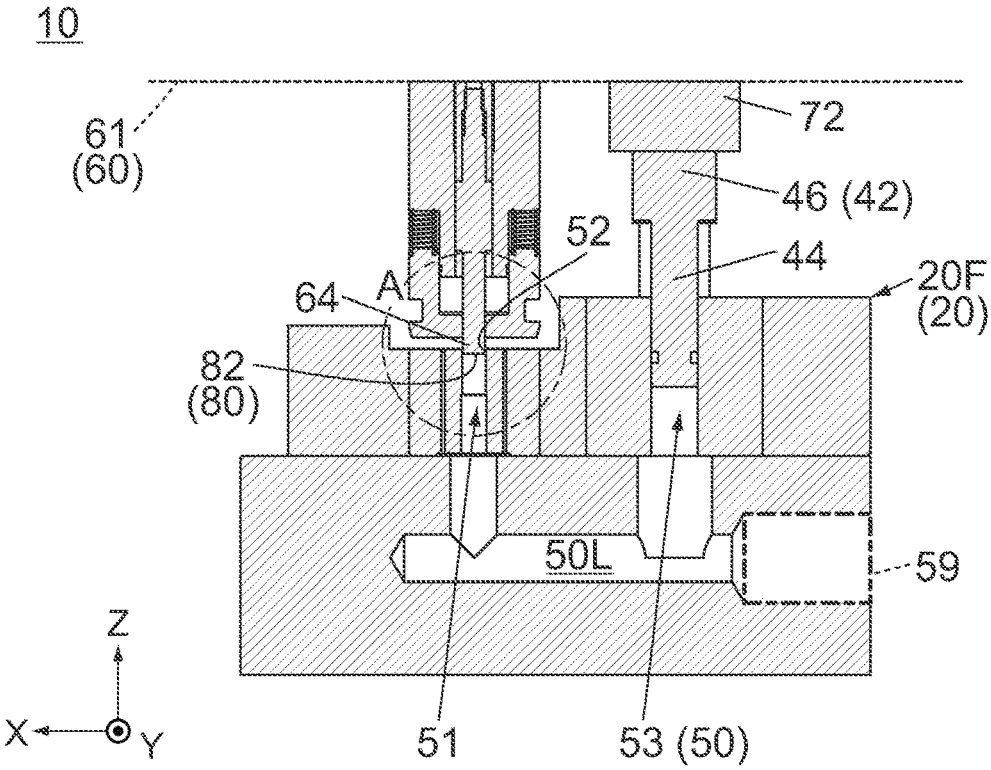
FIG. 7 is another cross-sectional view showing the workpiece processing apparatus of FIG. 5, wherein the slider is moved downward, and a lower end of the spacer is in contact with the piston.

Referring to FIG. 5, the punch 64 projects downward from the slider 61 and is moved in the upper-lower direction in accordance with the movement of the slider 61 in the upper-lower direction. Referring to FIGS. 5 and 7, when the slider 61 is moved downward from the upper position shown in FIG. 5 to a middle position shown in FIG. 7, a lower end of the punch 64 is brought into abutment with the workpiece 82 of the object 80 and presses the workpiece 82 into the workpiece processing chamber 51. As a result, the workpiece 82 is partially received into the workpiece processing chamber 51 and is brought into contact with the liquid surface 58 while being slightly deformed. Referring to FIG. 8, the workpiece 82 slightly pushes down the liquid surface 58, and thereby a passive hydraulic counterpressure POP which pushes the workpiece 82 upward is generated. This passive hydraulic counterpressure POP is very small in strength. When the hydraulic counterpressure POP is generated, the liquid surfaces 58 of the branch channels 56 are hardly raised and are located below the openings 57.

Referring to FIG. 7, the spacer 72 is moved in the upper-lower direction in accordance with the movement of the slider 61 in the upper-lower direction. When the slider 61 is moved downward to be located at the middle position shown in FIG. 7, a lower end of the spacer 72 is brought into contact with the pressed portion 46 of the piston 42. Referring to FIGS. 7 and 9, when the slider 61 is further moved downward, the slider 61 is moved to the lower position shown in FIG. 9. During the movement of the slider 61 from the middle position to the lower position, the spacer 72 continuously presses the piston 42 downward by a predetermined pressing force PP. The thus-pressed piston 42 is moved downward and applies the pressing force PP to the liquid 50L in the hydraulic-pressure generation chamber 53. As a result, an active hydraulic counterpressure OP (hereafter, simply referred to as "hydraulic counterpressure OP") of about 30 to 60 MPa is generated, for example. During the movement of the slider 61 from the middle position to the lower position, the punch 64 continuously presses the workpiece 82 against the hydraulic counterpressure OP, and thereby the workpiece 82 is drawn.

Summarizing the explanation described above with reference to FIGS. 5, 7 and 9, the piston 42 receives the downward pressing force PP from the slider 61 in a course of movement of the slider 61 from the upper position shown in FIG. 5 to the lower position shown in FIG. 9. When the slider 61 is moved from the upper position toward the lower position under a state where the hydraulic chamber 50 is filled with the liquid 50L and the workpiece 82 is placed on the workpiece processing chamber 51, the punch 64 is moved downward and presses the workpiece 82 into the workpiece processing chamber 51, and the piston 42 is moved downward in accordance with the pressing force PP and increases the hydraulic pressure of the liquid 50L.

The workpiece processing chamber 51 and the hydraulic-pressure generation chamber 53 of the present embodiment extend in parallel to each other in the upper-lower direction and open upward. According to this structure, by merely moving the slider 61 downward, the object 80 can be processed by the descending punch 64 while the hydraulic pressure is increased to a necessary high value by the descending piston 42. In addition, as previously described, the relief valve 59 controls the hydraulic pressure so that the hydraulic pressure does not exceed the predetermined value. In other words, the relief valve 59 works as a hydraulic pressure adjustment mechanism. The workpiece processing apparatus 10 of the present embodiment has the aforementioned simple mechanism and can be reduced in size. The present embodiment provides the workpiece processing apparatus 10 which is configured to use the hydraulic pressure to process the object 80 and has a structure suitable for the small object 80.

The workpiece processing apparatus 10 of the present embodiment is particularly suitable to process a small member such as a shell (not shown) of a connector (not shown) configured to be incorporated in an electronic device (not shown). For example, the workpiece processing apparatus 10 can shape the workpiece 82 having a size about several mm into a desired shape. However, the present invention is not limited thereto. For example, the size of the object 80 is not specifically limited.

Referring to FIG. 5, according to the present embodiment, when the slider 61 is located at the upper position shown in FIG. 5, a first distance, or a distance between the lower end of the punch 64 and the workpiece 82 of the object 80 in the upper-lower direction, is shorter than a second distance, or another distance between the lower end of the spacer 72 and an upper end of the piston 42 in the upper-lower direction. Referring to FIGS. 5 and 7, according to this arrangement, the piston 42 receives the pressing force PP after the processing of the workpiece 82 by the punch 64 starts. However, the present invention is not limited thereto. For example, the first distance may be longer than the second distance. In this instance, the workpiece 82 is processed by the punch 64 after the piston 42 receives the pressing force PP and generates the hydraulic counterpressure OP.

Referring to FIG. 9, the piston 42 of the present embodiment receives the pressing force PP from the slider 61 via the spacer 72. However, the present invention is not limited thereto. For example, when the spacer 72 is not provided, the piston 42 may directly receive the pressing force PP from the slider 61. More specifically, the lower end surface of the slider 61 may press the piston 42 downward.

Figure 10:
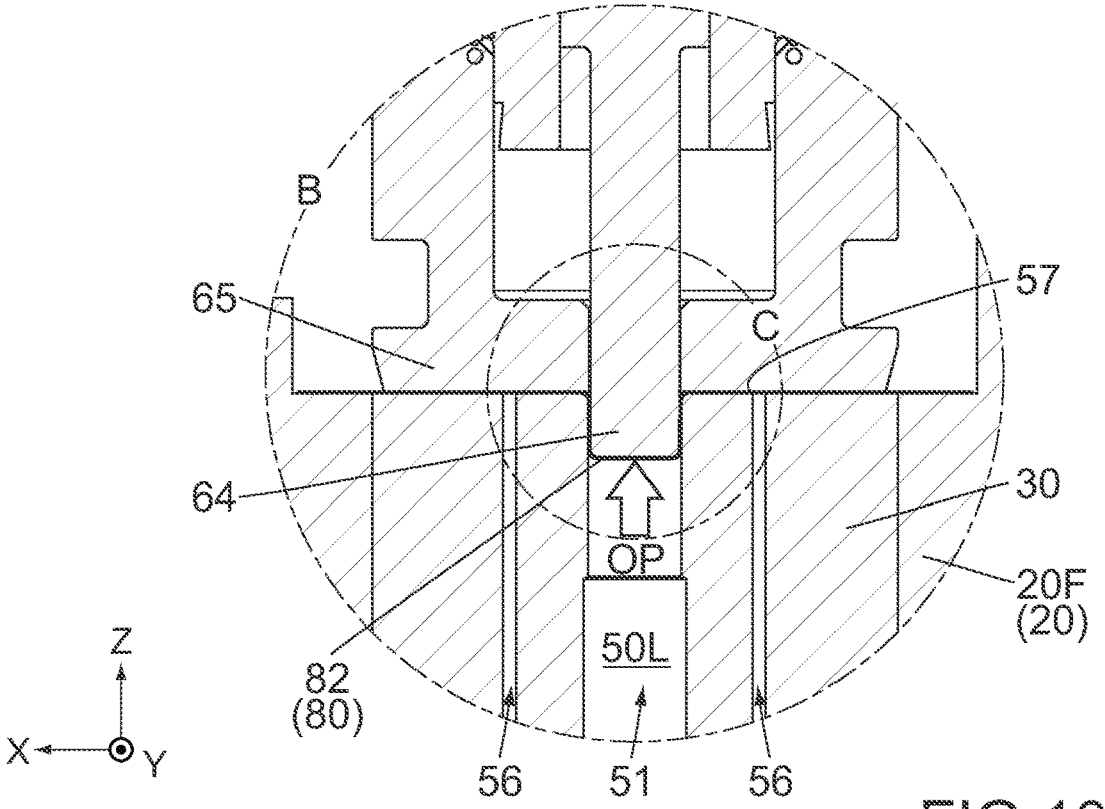
FIG. 10 is an enlarged, cross-sectional view showing a part of the workpiece processing apparatus enclosed by chain dotted lines B of FIG. 9.

Referring to FIGS. 9 and 10, according to the present embodiment, before the slider 61 is moved to the lower position shown in FIGS. 9 and 10, the lower end of the holder 65 is brought into abutment with an outer circumference of the workpiece 82 in the XY-plane. The holder-support member 66 is resiliently compressed while the slider 61 is moved toward the lower position. When the slider 61 is moved to the lower position, the holder 65 applies a force due to a restoring force of the holder-support member 66 to the outer circumference of the workpiece 82 in the XY-plane. As a result, the holder 65 presses the outer circumference of the workpiece 82 in the XY-plane against the upper end surface of the die 30.

Summarizing the explanation described above, according to the present embodiment, when the slider 61 is moved downward under a state where the workpiece 82 is placed on the workpiece processing chamber 51, the holder 65 is moved downward and presses the workpiece 82 against the base member 20F. According to this mechanism, the workpiece 82 can be drawn while the workpiece 82 is not formed with wrinkles. According to the present embodiment, the holder 65 presses the workpiece 82 after the processing by the punch 64 starts. However, the present invention is not limited thereto. For example, the holder 65 may press the workpiece 82 before the punch 64 starts to process the workpiece 82. More specifically, when the slider 61 is located at the upper position shown in FIG. 5, the holder 65 may project downward beyond the lower end of the punch 64. Moreover, as previously described, the holder 65 may be provided as necessary.

Figure 12:
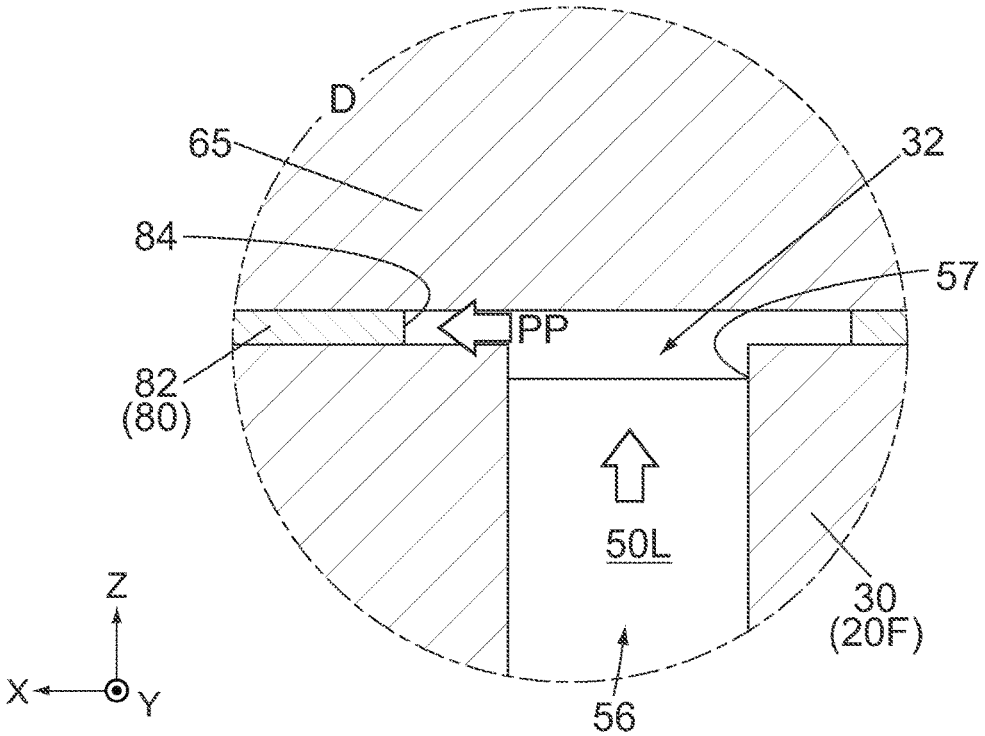
FIG. 12 is an enlarged, cross-sectional view showing a part of the workpiece processing apparatus enclosed by chain dotted lines D of FIG. 11.

Referring to FIGS. 11 and 12, the workpiece 82 pressed against the base member 20F forms a closed space including the recess 32 together with the holder 65 and the base member 20F. The openings 57 of the branch channels 56 open in this closed space. When the holder 65 presses the workpiece 82 against the base member 20F, the openings 57 of the branch channels 56 are located below the holder in the upper-lower direction and are located outward of a peripheral edge 84 of the workpiece 82 in the XY-plane.

Meanwhile, the liquid 50L flows into the closed space through the openings 57. The liquid 50L fills the closed space and applies the peripheral hydraulic pressure PP to the peripheral edge 84 of the workpiece 82. The workpiece 82 is pushed into the workpiece processing chamber 51 by the peripheral hydraulic pressure PP. According to this mechanism, the workpiece 82 can be easily drawn so that the workpiece 82 has a desired shape. Moreover, according to the present embodiment, the hydraulic counterpressure OP and the peripheral hydraulic pressure PP can be simultaneously generated by merely moving the single slider 61 (see FIG. 9) downward. However, the present invention is not limited thereto. The branch channels 56 may be provided as necessary as previously described.

Referring to FIG. 2, the workpiece processing apparatus 10 of the present embodiment comprises the three workpiece processing sets 12 as previously described. As described below, the workpiece processing sets 12 of the present embodiment generate the hydraulic pressures different from each other at timings different from each other.

Referring to FIG. 6, each of the pistons 42 of the three workpiece processing sets 12 receives the pressing force PP from the spacer 72 in a course of movement of the slider 61 from the upper position shown in FIG. 6 to the lower position shown in FIG. 9. When the slider 61 is located at the upper position, each of the spacers 72 is apart from the piston 42 by a predetermined distance D1, D2 or D3 in the upper-lower direction.

The predetermined distances D1, D2 and D3 of the present embodiment are different from each other. As can be seen from this distance condition, the pistons 42 of the present embodiment receive the pressing forces PP (see FIG. 9) from the spacers 72 at timings different from each other. However, the present invention is not limited thereto. For example, two of the three predetermined distances D1, D2 and D3 may be equal to each other. Thus, at least one of the predetermined distances D1, D2 and D3 may be different from a remaining one of the predetermined distances D1, D2 and D3. In other words, at least one of the pistons 42 may receive the pressing force PP from the slider 61 at a timing different from another timing at which a remaining one of the pistons 42 receives the pressing force PP.

Referring to FIG. 2, the punches 64 of the three workpiece processing sets 12 of the present embodiment have diameters same as each other. Referring to FIG. 6, the bodies 44 of the pistons 42 of the workpiece processing set 12F and 12S have diameters same as each other in the XY-plane, and thereby have cross-sectional areas same as each other in the XY-plane. In contrast, the body 44 of the piston 42 of the workpiece processing set 12T has a cross-sectional area different from those of the bodies 44 of the pistons 42 of the workpiece processing set 12F and 12S in the XY-plane. Thus, at least one of the bodies 44 has a cross-sectional area different from another cross-sectional area of a remaining one of the bodies 44 in the XY-plane.

According to the present embodiment, the workpiece processing set 12F and 12S generate the hydraulic pressures same as each other, but the workpiece processing set 12T generates the hydraulic pressure different from those of the workpiece processing set 12F and 12S. However, the present invention is not limited thereto. For example, the bodies 44 of the three workpiece processing sets 12 may have cross-sectional areas different from each other in the XY-plane. Thus, the three workpiece processing sets 12 may generate the hydraulic pressures different from each other.

According to the present embodiment, the hydraulic pressure of at least one of the workpiece processing sets 12 is different from the hydraulic pressure of a remaining one of the workpiece processing sets 12 at a predetermined timing. Referring to FIG. 9, the predetermined timing of the present embodiment is a timing when the workpiece 82 is processed.

Referring to FIG. 3, according to the present embodiment, the workpiece processing set 12F generates a relatively large hydraulic pressure at an early timing, the workpiece processing set 12S generates the same hydraulic pressure as that of the workpiece processing set 12F at a later timing, and the workpiece processing set 12T generates a relatively small hydraulic pressure at an even later timing.

Referring to FIG. 4, the workpiece processing apparatus 10 of the present embodiment comprises the three workpiece processing sets 12 as described above and can perform deep drawing to one of the workpieces 82 via the three processing steps each of which uses the hydraulic pressure. In other words, the workpiece processing apparatus 10 of the present embodiment is a deep drawing apparatus. The workpiece processing apparatus 10 can progressively process one of the workpieces 82 (see FIG. 1) by sequentially transferring the object 80 along the channel 18. For example, the workpiece processing set 12F can perform drawing, the workpiece processing set 12S can perform deeper drawing, and the workpiece processing set 12T can perform final drawing so that spring back can be prevented. Instead, different processes can be simultaneously performed to three of the workpieces 82, respectively. Moreover, another workpiece processing set 12 can be provided so that the workpiece 82 is cut off from the carrier 81 (see FIG. 1).

Referring to FIG. 2, the three workpiece processing members 62 of the present embodiment have shapes same as each other. However, the present invention is not limited thereto. For example, the three punches 64 may have diameters different from each other. In this instance, the workpiece processing chambers 51 (see FIG. 5) may have inner diameters which correspond to the punches 64, respectively.

Explaining the structure of the workpiece processing apparatus 10 of the present embodiment from another viewpoint with reference to FIG. 1, the workpiece processing apparatus 10 comprises a main member (partial device) 11 and the slider 61. The main member 11 of the present embodiment includes all the members of the illustrated workpiece processing apparatus 10 except the slider 61. The main member 11 is configured to form the workpiece processing apparatus 10 together with the slider 61, the workpiece processing apparatus 10 being configured to use the hydraulic-pressure to process the workpiece 82 of the object 80. Thus, the main member 11 is a partial device 11 of the workpiece processing apparatus 10. In other words, the workpiece processing apparatus 10 comprises the partial device 11 which works as the main member 11 of the workpiece processing apparatus 10.

The main member 11 of the present embodiment comprises at least the base member 20, the punches 64 (see FIG. 2), the holders 65 (see FIG. 2), the holder-support members 66 (see FIG. 2) and the spacers 72 (see FIG. 3). Each member of the main member 11 has the already described structure and works as already described. For example, when the workpiece processing apparatus 10 is formed, the slider 61 is located above the base member 20 in the upper-lower direction and is movable in the upper-lower direction between the upper position shown in FIG. 5 and the lower position shown in FIG. 9. The punches 64, the holders 65 and the spacers 72 are attachable to the slider 61. When the punches 64 are attached to the slider 61, the punches 64 project downward from the slider 61 and are moved in the upper-lower direction in accordance with the movement of the slider 61 in the upper-lower direction.

The workpiece processing apparatus 10 of the present embodiment can be further variously modified in addition to the already described modifications. Hereafter, explanation will be made about one of modifications of the workpiece processing apparatus 10.

Figure 13:
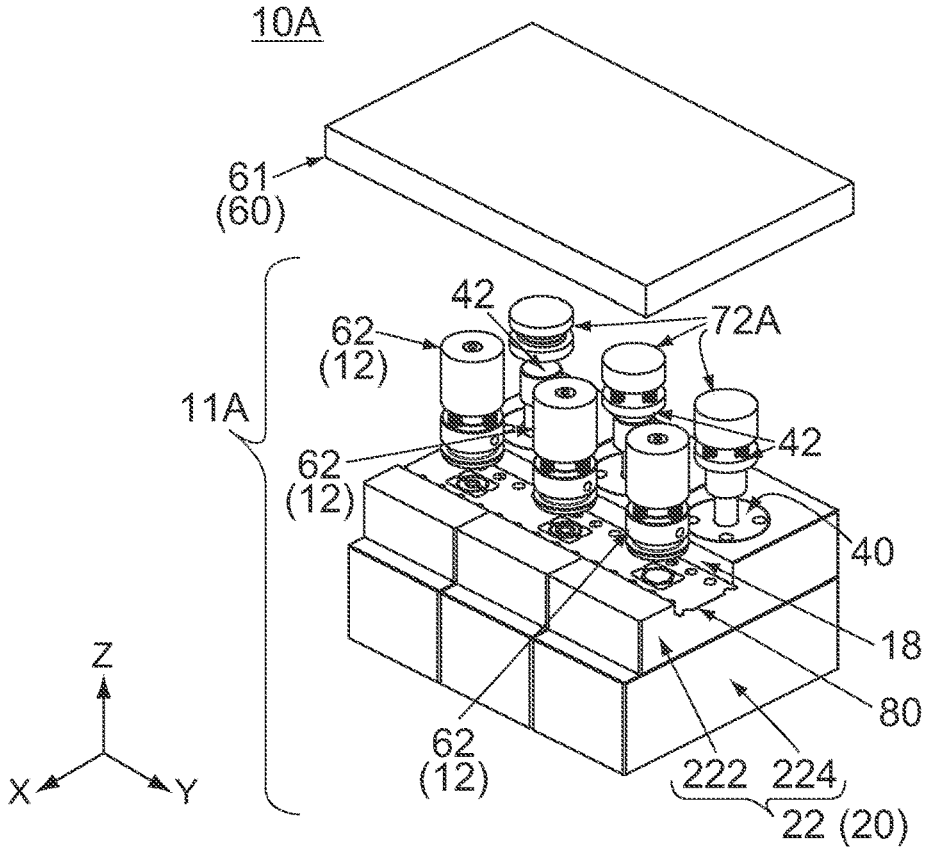
FIG. 13 is a perspective view showing a modification of the workpiece processing apparatus of FIG. 1.

Comparing FIG. 13 with FIG. 1, a workpiece processing apparatus 10A according to the present modification comprises three spacers 72A instead of the spacers 72 of the workpiece processing apparatus 10. Thus, the workpiece processing apparatus 10A comprises a main member (partial device) 11A different from the main member 11 of the workpiece processing apparatus 10. The main member 11A of the present modification includes all the members of the illustrated workpiece processing apparatus 10A except the slider 61. Except for the differences described above, the workpiece processing apparatus 10A has the same structure as that of the workpiece processing apparatus 10.

Figure 14:
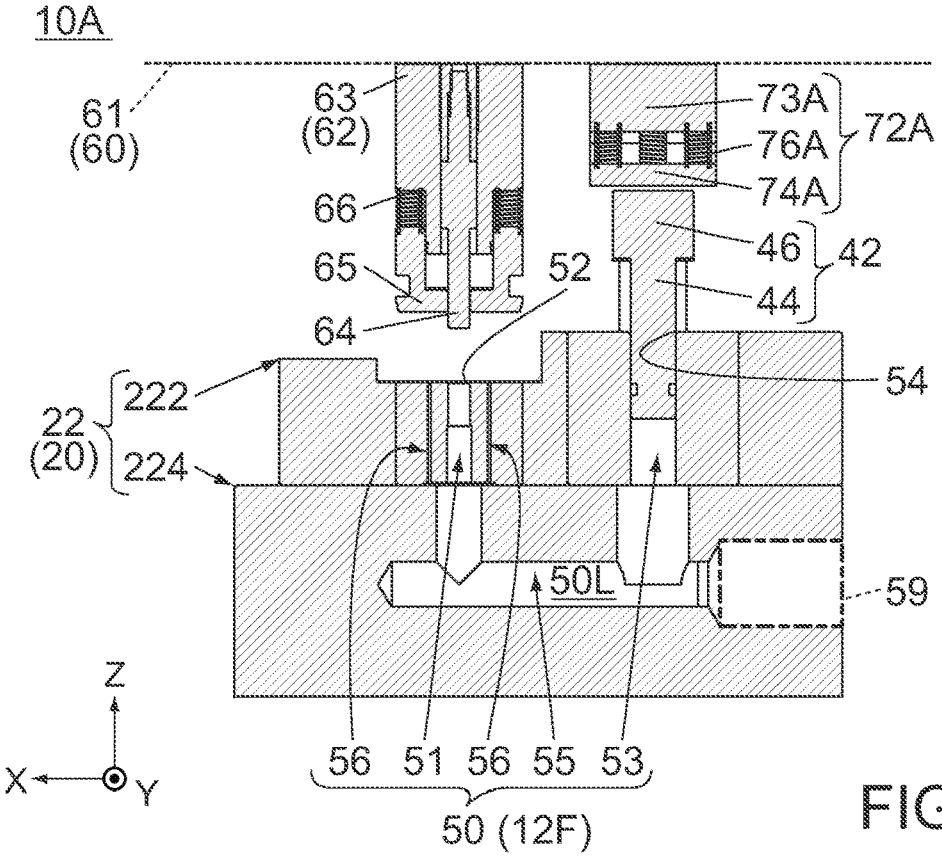
FIG. 14 is a cross-sectional view showing the workpiece processing apparatus of FIG. 13, wherein the illustrated cross-section corresponds to the cross-section of FIG. 5.
Figure 15:
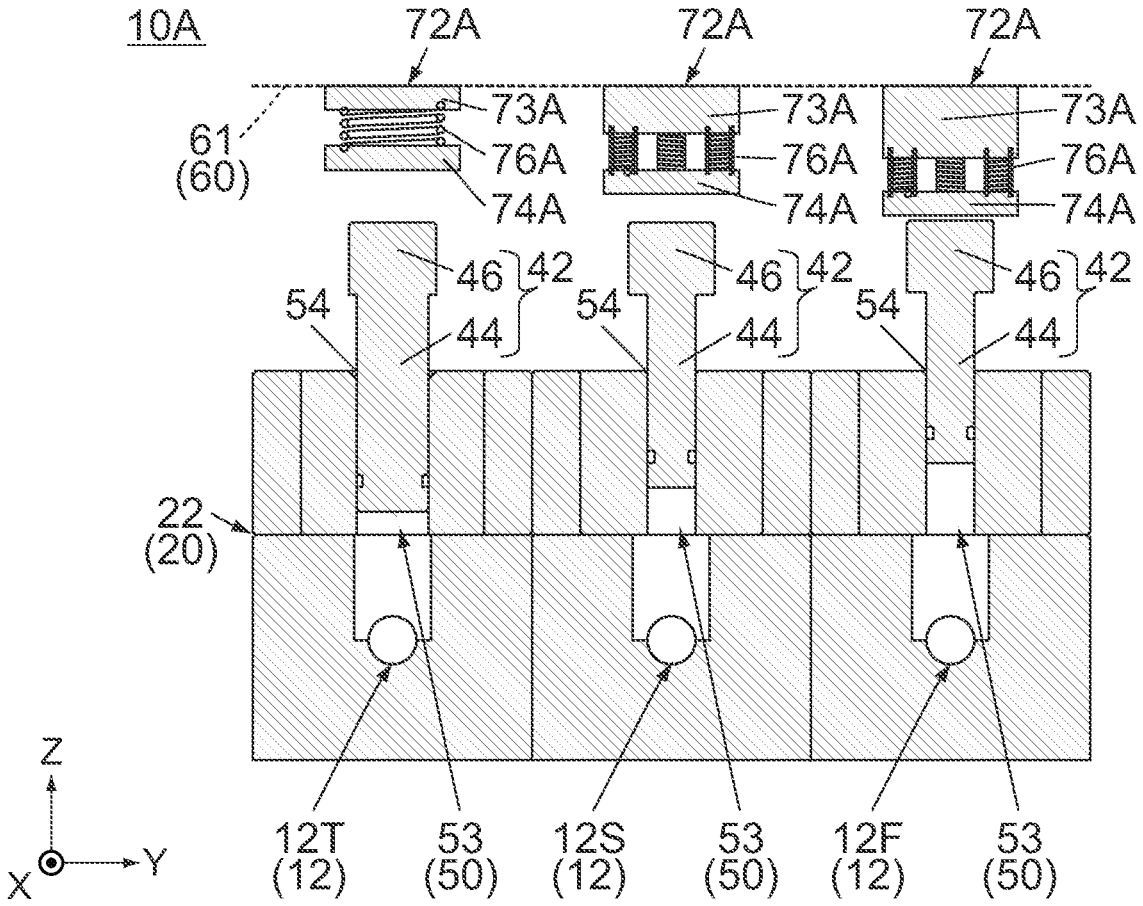
FIG. 15 is another cross-sectional view showing the workpiece processing apparatus of FIG. 13, wherein the illustrated cross-section corresponds to the cross-section of FIG. 6.
Figure 16:
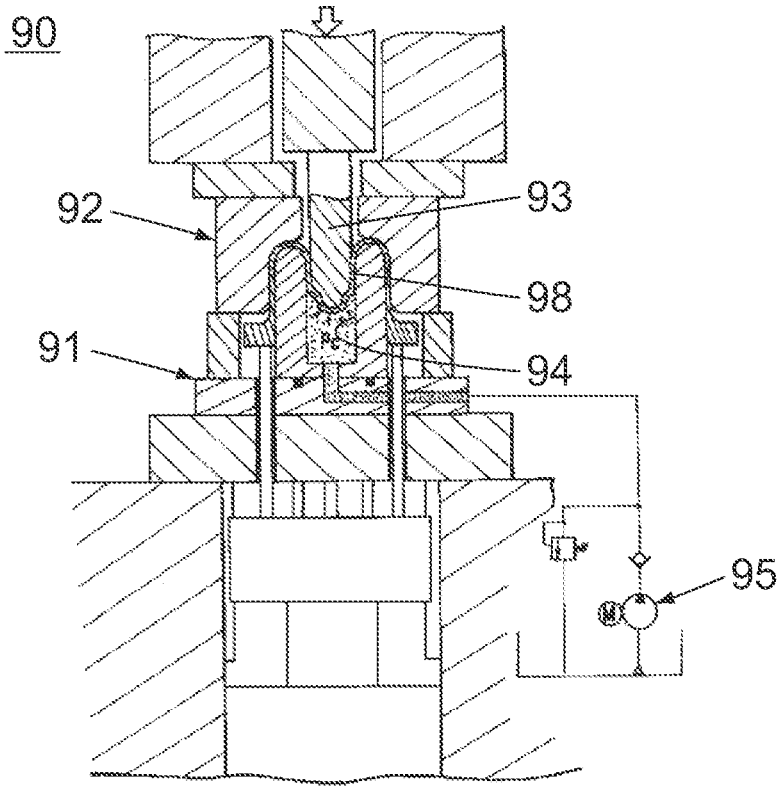
FIG.16 PRIOR ART
FIG. 16 is a cross-sectional view showing a workpiece processing apparatus of Patent Document 1.

Referring to FIGS. 14 and 15, each of the spacers 72A comprises a base 73A made of metal, a pressing portion 74A made of metal and a support member 76A. Each of the bases 73A and the pressing portions 74A has a cylindrical shape extending along the upper-lower direction. Each of the bases 73A is fixed to the single slider 61 and projects downward from the slider 61. Each of the pressing portions 74A is configured to press the piston 42 downward. Each of the support members 76A is formed of one or more metal springs and has resiliency. In each of the spacers 72A, an upper end of each of the metal springs is attached to the base 73A, and a lower end of each of the metal springs is attached to the pressing portion 74A. According to this structure, each of the support members 76A supports the pressing portion 74A so that the pressing portion 74A is movable in the upper-lower direction relative to the slider 61.

As can be seen from FIG. 15, when the slider 61 is moved downward, the pressing portion 74A of the workpiece processing set 12F, the pressing portion 74A of the workpiece processing set 12S and the pressing portion 74A of the workpiece processing set 12T press the pistons 42 in this order and generate the hydraulic pressures. Thus, timings at which the three workpiece processing sets 12 of the workpiece processing apparatus 10A generate the hydraulic pressures are different from each other. Moreover, the support member 76A of the workpiece processing set 12T has a spring force which is different from those of the support member 76A of the workpiece processing set 12F and the support member 76A of the workpiece processing set 12S and thereby generates the hydraulic pressure which is different from those of the workpiece processing set 12F and the workpiece processing set 12S.

Explaining about the workpiece processing set 12F with reference to FIG. 14, the hydraulic pressure generated according to the present modification is adjustable by the spring force of the support member 76A, more specifically, by elastic modulus of the metal spring. Accordingly, the hydraulic pressure can be more reliably prevented from exceeding the predetermined value. Thus, the support members 76A work as the hydraulic pressure adjustment mechanism together with the relief valve 59.

What is claimed is:

1. A workpiece processing apparatus configured to use hydraulic pressure to process a workpiece of an object, the workpiece processing apparatus comprising:

a main member; and a slider;

wherein:

the main member comprises a base member and a punch;

the slider is located above the base member in an upper-lower direction and is movable between an upper position and a lower position in the upper-lower direction;

the punch projects downward from the slider and is configured to move in the upper-lower direction in accordance with a movement of the slider in the upper-lower direction;

the base member is formed with a hydraulic chamber;

the hydraulic chamber is fillable with liquid;

the hydraulic chamber has a workpiece processing chamber, a hydraulic-pressure generation chamber and a coupling chamber;

each of the workpiece processing chamber and the hydraulic-pressure generation chamber extends in the upper-lower direction and opens upward;

the coupling chamber couples the workpiece processing chamber and the hydraulic-pressure generation chamber together in a front-rear direction perpendicular to the upper-lower direction;

the base member comprises a piston;

the piston is partially received in the hydraulic-pressure generation chamber so that the piston is movable in the upper-lower direction and projects upward from the hydraulic-pressure generation chamber;

the piston receives a downward pressing force from the slider in a course of movement of the slider from the upper position to the lower position;

the slider, the punch, and the piston are configured such that, when the slider is moved from the upper position toward the lower position under a state where the hydraulic chamber is filled with the liquid and the workpiece is placed on the workpiece processing chamber, the punch is moved downward and presses the workpiece into the workpiece processing chamber, and the piston is moved downward in accordance with the pressing force and increases hydraulic pressure of the liquid;

the hydraulic chamber is provided with a relief valve; and the relief valve controls the hydraulic pressure so that the hydraulic pressure does not exceed a predetermined value.

2. The workpiece processing apparatus as recited in claim 1, wherein:

the workpiece processing apparatus comprises two or more workpiece processing sets;

each of the workpiece processing sets includes the hydraulic chamber and the punch;

all the punches project downward from the single slider; and the hydraulic pressure of at least one of the workpiece processing sets is different from the hydraulic pressure of a remaining one of the workpiece processing sets at a predetermined timing.

3. The workpiece processing apparatus as recited in claim 2, wherein at least one of the pistons receives the pressing force from the slider at a timing different from another timing at which a remaining one of the pistons receives the pressing force.

4. The workpiece processing apparatus as recited in claim 3, wherein:

the main member comprises a holder and a holder-support member;

the holder is located outward of the punch in a horizontal plane perpendicular to the upper-lower direction;

the holder-support member has resiliency and supports the holder so that the holder is movable relative to the slider; and when the slider is moved downward under a state where the workpiece is placed on the workpiece processing chamber, the holder is moved downward and presses the workpiece against the base member.

5. The workpiece processing apparatus as recited in claim 4, wherein:

the hydraulic chamber has a branch channel;

the branch channel branches off from the workpiece processing chamber and has an opening which opens outward from the base member; and when the holder presses the workpiece against the base member, the opening is located below the holder in the upper-lower direction and is located outward of a peripheral edge of the workpiece in the horizontal plane.

6. The workpiece processing apparatus as recited in claim 2, wherein:

each of the workpiece processing sets includes a spacer;

all the spacers project downward from the single slider;

each of the pistons receives the pressing force from the spacer in the process in which the slider is moved from the upper position to the lower position;

when the slider is located at the upper position, each of the spacers is apart from the piston by a predetermined distance in the upper-lower direction; and at least one of the predetermined distances is different from a remaining one of the predetermined distances.

7. The workpiece processing apparatus as recited in claim 6, wherein:

each of the spacers comprises a pressing portion and a support member;

each of the pressing portions is configured to press the piston downward; and each of the support members has resiliency and supports the pressing portion so that the pressing portion is movable relative to the slider.

8. The workpiece processing apparatus as recited in claim 7, wherein:

the main member comprises a holder and a holder-support member;

the holder is located outward of the punch in a horizontal plane perpendicular to the upper-lower direction;

the holder-support member has resiliency and supports the holder so that the holder is movable relative to the slider; and when the slider is moved downward under a state where the workpiece is placed on the workpiece processing chamber, the holder is moved downward and presses the workpiece against the base member.

9. The workpiece processing apparatus as recited in claim 8, wherein:

the hydraulic chamber has a branch channel;

the branch channel branches off from the workpiece processing chamber and has an opening which opens outward from the base member; and when the holder presses the workpiece against the base member, the opening is located below the holder in the upper-lower direction and is located outward of a peripheral edge of the workpiece in the horizontal plane.

10. The workpiece processing apparatus as recited in claim 4, wherein:

the main member comprises a holder and a holder-support member;

the holder is located outward of the punch in a horizontal plane perpendicular to the upper-lower direction;

the holder-support member has resiliency and supports the holder so that the holder is movable relative to the slider; and when the slider is moved downward under a state where the workpiece is placed on the workpiece processing chamber, the holder is moved downward and presses the workpiece against the base member.

11. The workpiece processing apparatus as recited in claim 10, wherein:

the hydraulic chamber has a branch channel;

the branch channel branches off from the workpiece processing chamber and has an opening which opens outward from the base member; and when the holder presses the workpiece against the base member, the opening is located below the holder in the upper-lower direction and is located outward of a peripheral edge of the workpiece in the horizontal plane.

12. The workpiece processing apparatus as recited in claim 2, wherein:

each of the pistons has a body;

each of the bodies is partially received in the hydraulic-pressure generation chamber; and at least one of the bodies has a cross-sectional area different from another cross-sectional area of a remaining one of the bodies in a plane perpendicular to the upper-lower direction.

13. The workpiece processing apparatus as recited in claim 12, wherein:

the main member comprises a holder and a holder-support member;

the holder is located outward of the punch in a horizontal plane perpendicular to the upper-lower direction;

the holder-support member has resiliency and supports the holder so that the holder is movable relative to the slider; and when the slider is moved downward under a state where the workpiece is placed on the workpiece processing chamber, the holder is moved downward and presses the workpiece against the base member.

14. The workpiece processing apparatus as recited in claim 13, wherein:

the hydraulic chamber has a branch channel;

the branch channel branches off from the workpiece processing chamber and has an opening which opens outward from the base member; and when the holder presses the workpiece against the base member, the opening is located below the holder in the upper-lower direction and is located outward of a peripheral edge of the workpiece in the horizontal plane.

15. The workpiece processing apparatus as recited in claim 2, wherein:

the main member comprises a holder and a holder-support member;

the holder is located outward of the punch in a horizontal plane perpendicular to the upper-lower direction;

the holder-support member has resiliency and supports the holder so that the holder is movable relative to the slider; and when the slider is moved downward under a state where the workpiece is placed on the workpiece processing chamber, the holder is moved downward and presses the workpiece against the base member.

16. The workpiece processing apparatus as recited in claim 15, wherein:

the hydraulic chamber has a branch channel;

the branch channel branches off from the workpiece processing chamber and has an opening which opens outward from the base member; and when the holder presses the workpiece against the base member, the opening is located below the holder in the upper-lower direction and is located outward of a peripheral edge of the workpiece in the horizontal plane.

17. The workpiece processing apparatus as recited in claim 1, wherein:

the main member comprises a holder and a holder-support member;

the holder is located outward of the punch in a horizontal plane perpendicular to the upper-lower direction;

the holder-support member has resiliency and supports the holder so that the holder is movable relative to the slider; and when the slider is moved downward under a state where the workpiece is placed on the workpiece processing chamber, the holder is moved downward and presses the workpiece against the base member.

18. The workpiece processing apparatus as recited in claim 17, wherein:

the hydraulic chamber has a branch channel;

the branch channel branches off from the workpiece processing chamber and has an opening which opens outward from the base member; and when the holder presses the workpiece against the base member, the opening is located below the holder in the upper-lower direction and is located outward of a peripheral edge of the workpiece in the horizontal plane.

19. A main member comprising:

a base member; and a punch, wherein:

the main member is usable in a workplace processing apparatus that includes the main member and a slider, in which the slider is located above the base member in an upper-lower direction and is movable between an upper position and a lower position in the upper-lower direction;

the punch is attachable to the slider in a manner such that the punch projects downward from the slider and is configured to move in the upper-lower direction in accordance with a movement of the slider in the upper-lower direction;

the base member is formed with a hydraulic chamber;

the hydraulic chamber is fillable with liquid;

the hydraulic chamber has a workpiece processing chamber, a hydraulic-pressure generation chamber and a coupling chamber;

each of the workpiece processing chamber and the hydraulic-pressure generation chamber extends in the upper-lower direction and opens upward;

the coupling chamber couples the workpiece processing chamber and the hydraulic-pressure generation chamber together in a front-rear direction perpendicular to the upper-lower direction;

the base member comprises a piston;

the piston is partially received in the hydraulic-pressure generation chamber so that the piston is movable in the upper-lower direction and projects upward from the hydraulic-pressure generation chamber;

the piston is configured to receive a downward pressing force from the slider in a course of movement of the slider from the upper position to the lower position;

the main member is configured such that when the slider is moved from the upper position toward the lower position under a state where the hydraulic chamber is filled with the liquid and the workpiece is placed on the workpiece processing chamber, the punch is moved downward and presses the workpiece into the workpiece processing chamber, and the piston is moved downward in accordance with the pressing force and increases hydraulic pressure of the liquid;

the hydraulic chamber is provided with a relief valve; and the relief valve controls the hydraulic pressure so that the hydraulic pressure does not exceed a predetermined value.

* * * * *